United States Patent [19]

Helm et al.

[11] Patent Number: 4,969,075

[45] Date of Patent: Nov. 6, 1990

[54] LOW-GLARE LIGHT

[75] Inventors: Randall S. Helm, Kentwood; Richard A. Benoit, East Grand Rapids, both of Mich.

[73] Assignee: Steelcase Inc., Grand Rapids, Mich.

[21] Appl. No.: 348,301

[22] Filed: May 5, 1989

[51] Int. Cl.[5] ..... F21V 5/00

[52] U.S. Cl. ..... 362/330; 362/223; 362/328

[58] Field of Search ..... 362/33, 223, 328, 339, 362/260, 330

[56] References Cited

U.S. PATENT DOCUMENTS

| | | | |
|---|---|---|---|
| 4,054,793 | 10/1977 | Shemitz | 362/330 X |
| 4,233,651 | 11/1980 | Fabbri | 362/260 X |
| 4,242,723 | 12/1980 | Fabbri et al. | 362/33 |
| 4,260,220 | 4/1981 | Whitehead | 350/96.28 |
| 4,368,504 | 1/1983 | Sato et al. | 362/339 X |
| 4,542,449 | 9/1985 | Whitehead | 362/330 |
| 4,562,515 | 12/1985 | Lautzenheiser | 362/339 X |
| 4,615,579 | 10/1986 | Whitehead | 350/96.1 |
| 4,669,034 | 5/1987 | Bansbach et al. | 362/339 X |
| 4,791,540 | 12/1988 | Dreyer, Jr. et al. | 362/33 R |

*Primary Examiner*—Stephen F. Husar

*Attorney, Agent, or Firm*—Price, Heneveld, Cooper, DeWitt & Litton

[57] ABSTRACT

A low-glare light having a light source behind a transparent sheet of dielectric material. The transparent sheet has a prismatic surface on one side containing a plurality of elongated prisms and a plano surface on the opposite side. The transparent sheet is positioned with the prismatic surface facing the source of light with the elongated prisms perpendicular to the source of light.

1 Claim, 2 Drawing Sheets

LOW-GLARE LIGHT

BACKGROUND OF THE INVENTION

In lighting a room or workspace, it is important to have the light uniformly distributed. An incandescent bulb or a fluorescent tube, when illuminated, produces an area of high-intensity illumination bounded by areas of gradually decreasing intensity. When a person works under such a light, it tends to cause eyestrain due to the difference in the illumination and the glare from the bright spot immediately in line with the source of light.

In order to overcome this problem, it has been common practice in the past to put a diffuser in front of the incandescent bulb or fluorescent tube to spread the light over the workspace. While this improves the problem substantially, bright spots are still left which cause a problem in working and particularly in attempting read under such a light. The problem is particularly severe in attempting to read from a magazine or book printed on high gloss paper.

In 1981, Loren A. Whitehead obtained U.S. Pat. No. 4,260,220, Apr. 7, 1981, entitled PRISM LIGHT GUIDE HAVING SURFACES WHICH ARE IN OCTATURE. This patent was directed to a novel class of materials which could be used to pipe light into darkened areas. The material was a transparent sheet of plastic material having a smooth surface or a plano surface on one side and a pattern of elongated prism-like grooves on the opposite side. According to the teaching of the patent, the material could be formed into a hollow structure having a smooth inner surface and a grooved surface on the outside having the prisms or grooves running in the long direction of the structure. It was found, in using this material, that if light entered one end it would travel through the tube using total internal reflection to emerge at the far end without a substantial loss in brightness. Two additional patents were issued to Whitehead. The first, U.S. Pat. No. 4,542,449, on Sept. 17, 1985, and the second U.S. Pat. No. 4,615,579, Oct. 7, 1986, disclosed additional uses for the material. Again, the patents taught the use of the material as a light pipe and as a luminaire or source of light in which the material would be shaped and provided with extractors and reflecting surfaces to direct the light to emerge from one side of the elongated light pipe configuration.

Flat panels of the material are also taught using two sheets of material. The first sheet would be put in place with the prism surface pointing outward and a second sheet of the material would be laid over the first with the prism surface contacting the smooth surface of the first sheet and with the elongated prisms of the second sheet set at an angle to the prisms on the first sheet. The teaching of all three of these patents are incorporated herein by reference. The prismatic material is available in thin sheet from from the 3M Corporation where it is sold under the trademark SCOTCHLAMP. In all of the above-mentioned applications using the film, the light is imposed on the smooth surface and is conducted as a light pipe by internal reflections off of the prism faces or, in a luminaire or light panel configuration, the light strikes the smooth surface first and emerges from the corrugated or prism-like surface. No teaching is found in any of these patents for the use of the material with the corrugated or prism-like surface pointing inward toward the light source and with the smooth surface outward. Applicants have found some surprising and improved light diffusion effects when the film is used in this configuration.

SUMMARY OF THE INVENTION

In accordance with the present invention, an improved, low-glare light source has been developed employing a transparent prismatic material between the light source and the area or workspace to be illuminated. The improved, low-glare light has a socket for holding a light source, such as an incandescent bulb or a fluorescent tube. In front of the light source, a light spreading material is positioned. The light spreading material is a sheet of transparent dielectric material having a pattern of elongated, prism-like grooves on one side and a plano finish on the other. The sheet is positioned with the prismatic surface facing toward the light source and with the elongated grooves perpendicular to the light source. With the prismatic material positioned in this manner, the light tends to have fewer bright spots and to produce a substantially uniform and more usable light.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE PREFERRED EMBODIMENT

Figure 1:
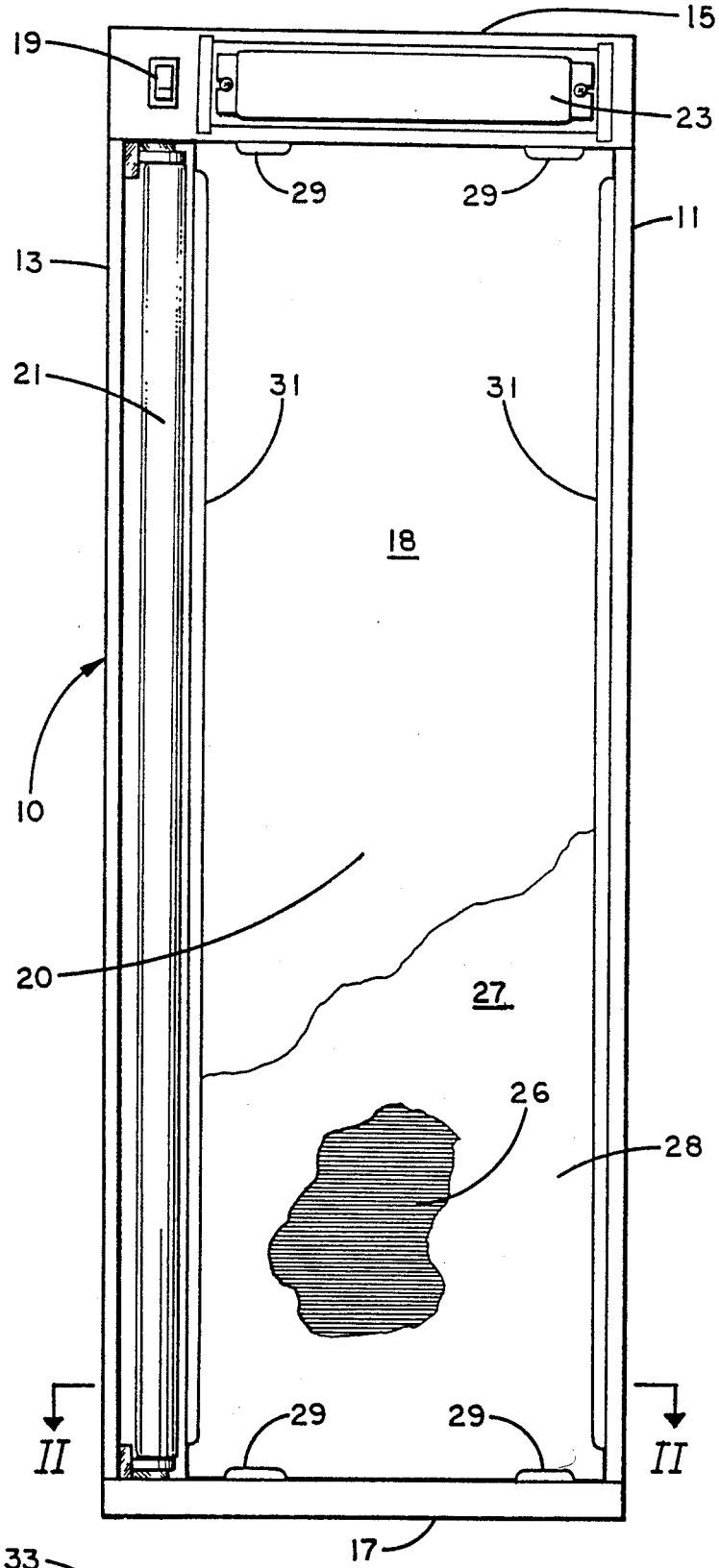
FIG. 1 is a plan view of a low-glare light.

In referring to FIG. 1, a low-glare light is shown and indicated generally by the number 10. The light has a housing made up of a front 11, a rear 13 and opposing ends 15 and 17. The housing would normally have a top 18 to complete the enclosure and to protect the inside from random dust and dirt. The housing can be made of aluminum, steel or polymeric materials. A switch 19 for turning the light on and off is positioned near one corner of the housing. A fluorescent tube 21 extends substantially the full length of the housing near the rear thereof. A ballast transformer 23 for the fluorescent tube is positioned adjacent the switch 19. The light emitting opening 20 in the low-glare light is closed by a transparent diffuser 27, FIGS. 1 and 2, which is held by supports 29 at each end of the light fixture and by supports 31 on the sides of the light fixture.

Figure 2:
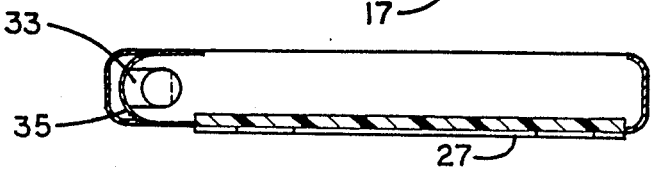
FIG. 2 is a side elevation view, partially in section, of the low-glare light, taken along the line II—II of FIG. 1.

As shown in FIG. 2, one end socket 33 is shown for supporting the fluorescent tube 21. As is well-known, there is a substantially identical socket 33 at the remote end of the fluorescent tube. A reflector 35 is positioned behind the fluorescent tube to direct the light toward the opening 20 in the light fixture. The reflector can be a white or mirror-like surface or a piece of SCOTCHLAMP film with the prisms away from the tube and perpendicular to the tube. No wiring is shown for connecting the fluorescent tube 21, the socket 33, the transformer 23 and the switch 19 so as not to clutter the drawing.

Figure 4:
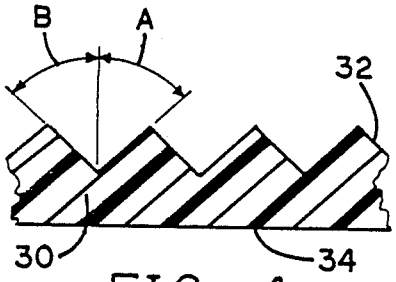
FIG. 4 is a sectional view of a piece of prismatic material showing typical dimensions.

The light diffuser 27, referring to FIG. 4, is made from a sheet of transparent polymeric material 30 having a prism-like surface on one side 32 and a plano surface 34 on the other. Each prism of the prism-like surface joins the adjacent prism at a 90° angle. Each individual prism has a face at a 45° angle to a line perpendicular to the plano surface and passing through the trough of the prism. In the preferred embodiment, the diffuser is positioned in the light fixture with the prism-like ridges and grooves 26 perpendicular to the fluorescent tube light source 21 as shown in a partial view in FIG. 1 with the plano surface 28 removed to reveal the prismatic surface. While a 90° angle is preferred, the angle can be varied to suit particular lighting requirements. As the angle of the prisms relative to the fluorescent tube is decreased, the number of light spots appearing in the diffuser increase until, when the prisms are parallel to the fluorescent tube, the diffuser is equivalent to a conventional diffuser which would suffer from having a long light spot.

Figure 3:
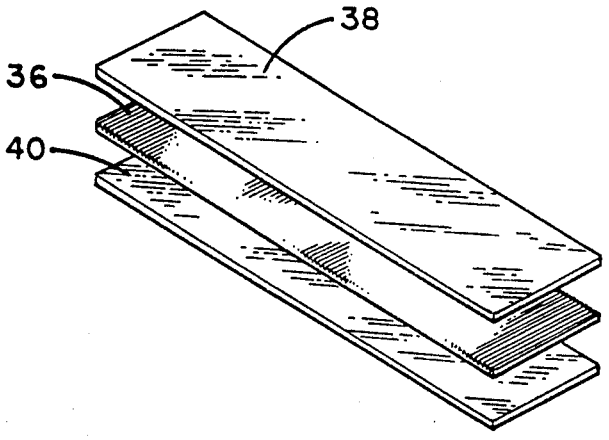
FIG. 3 is a view of a composite structure having a sheet of the prismatic material positioned between two clear sheets of material to provide physical support for the prismatic material.

The light fixtures can be made in many different lengths to suit the commercially available fluorescent light tubes. Also incandescent bulbs with or without an internal reflector can be used as a point source of light with the inventive diffuser. As the length or configuration of the housing changes, an option is presented of using either a self-supporting sheet of prismatic material or a thin film of the prismatic material can be employed, as shown in FIG. 3, where the film 36 is sandwiched between two clear pieces of glass or polymeric material 38, 40. The thin film material is available, as previously mentioned, from the 3M Corporation under the trademark SCOTCHLAMP. The film is also available from licensees of the 3M Corporation.

The prismatic material, whether self-supporting or in the form of SCOTCHLAMP film, is preferably made of optical grade polycarbonate material. Other polymeric materials with substantially similar optical and physical properties can also be used. The preferred material is SCOTCHLAMP film in combination with at least one supporting sheet as shown in FIG. 3. The film is commercially available with a thickness of 0.020″±0.003 and in many different lengths. Obviously, other film thicknesses can be used that have the same optical properties.

Figure 5:
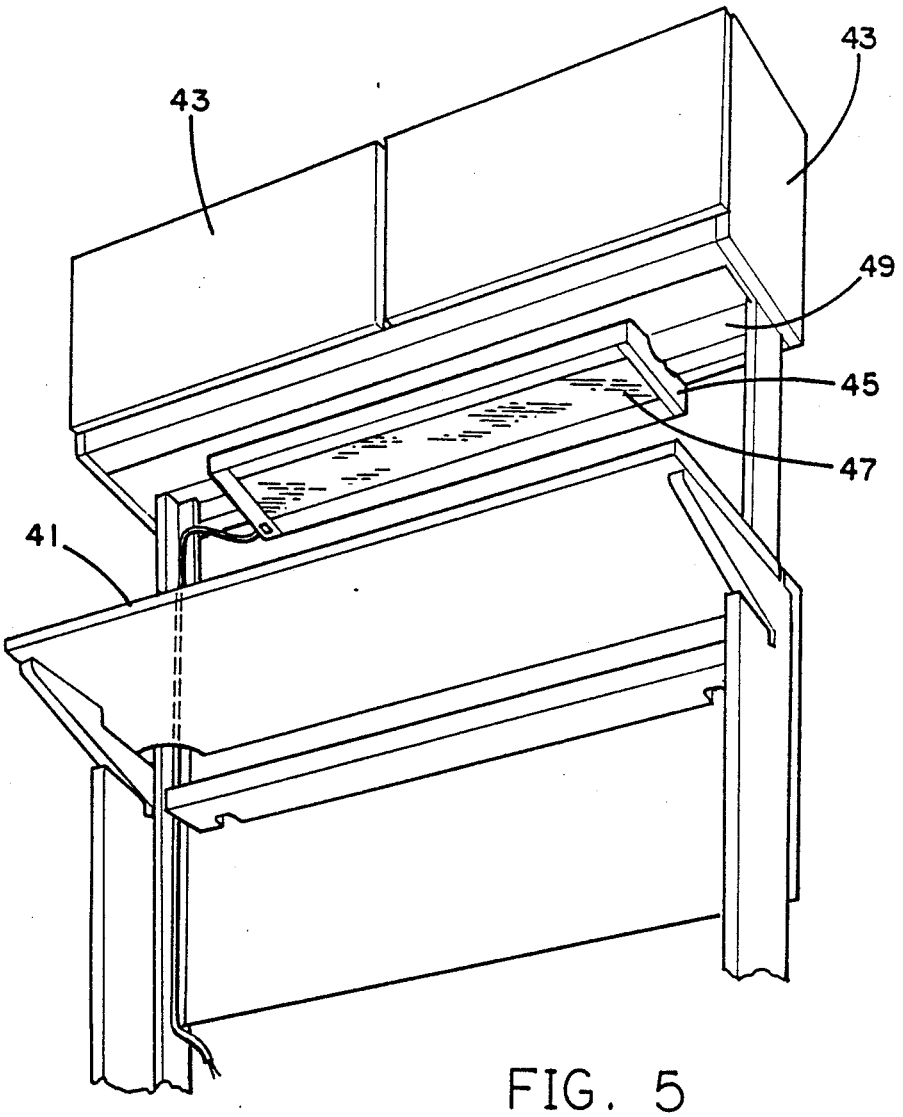
FIG. 5 shows a modular functional unit having a workspace positioned below a low-glare light.

A preferred application for the low-glare light of the present invention is as a task light to illuminate a workspace, such as a desktop. The low-glare light is particularly useful in applications where modular furniture is employed, referring to FIG. 5, having a work surface 41 below a storage cabinet 43. A task light 45 with a prismatic diffuser 47 of the size needed to fit above the workspace can be suspended from the bottom 49 of storage cabinets 43 to provide uniform illumination of the working surface substantially free of bright spots which are so common with current light diffusers.

Though the invention has been described with respect to specific preferred embodiments thereof, many variations and modifications will immediately become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A low-glare task light comprising:

a housing for supporting the light and for protecting it from dust and dirt;

a socket for a light source disposed in said housing;

a diffuser for evenly spreading the light coming from the housing over a workspace, said diffuser comprising a sheet of prismatic material having a pattern of elongated contiguous prism-like grooves on one surface and plane opposite surface, said prismatic material being positioned in the housing with the grooves facing the source of light in said housing and with the grooves positioned relative to the source of light to that angle which produces optimum diffusion and minimum bright spots on a workspace to be illuminated.

* * * * *